US008316568B2

(12) United States Patent
Briggs

(10) Patent No.: US 8,316,568 B2
(45) Date of Patent: Nov. 27, 2012

(54) COMPOSITE FIREARM BARREL REINFORCEMENT

(75) Inventor: Vernon R. Briggs, Sunapee, NH (US)

(73) Assignee: Sturm, Ruger & Company, Inc., Southport, CT (US)

( * ) Notice: Subject to any disclaimer, the term of this patent is extended or adjusted under 35 U.S.C. 154(b) by 0 days.

(21) Appl. No.: 13/050,228

(22) Filed: Mar. 17, 2011

(65) Prior Publication Data

US 2011/0162246 A1 Jul. 7, 2011

Related U.S. Application Data

(60) Division of application No. 11/879,544, filed on Jul. 18, 2007, now Pat. No. 7,921,590, and a continuation-in-part of application No. 11/360,197, filed on Feb. 23, 2006, now Pat. No. 7,934,332.

(51) Int. Cl.
*F41A 21/00* (2006.01)

(52) U.S. Cl. ..... 42/76.02; 89/16

(58) Field of Classification Search ..... 42/76.01; 89/16

See application file for complete search history.

(56) References Cited

U.S. PATENT DOCUMENTS

| | | | |
|---|---|---|---|
| 1,355,422 | A | 10/1920 | Pedersen |
| 1,441,459 | A | 1/1923 | Small |
| 2,137,259 | A | 11/1938 | Boak |
| 2,371,125 | A | 3/1945 | Bannister |
| 2,609,631 | A | 9/1952 | Garand |
| 2,780,019 | A | 2/1957 | Sullivan |
| 2,975,677 | A | 3/1961 | Kelly, Jr. |
| 2,981,155 | A | 4/1961 | Parlanti |
| 2,990,342 | A | 6/1961 | Sullivan |
| 2,992,596 | A | 7/1961 | Hammer |
| 3,118,243 | A | 1/1964 | Manshel |
| 3,125,806 | A | 3/1964 | Cameron |
| 3,177,688 | A | 4/1965 | Kralowetz |
| 3,235,996 | A | 2/1966 | Maillard |
| 3,351,994 | A | 11/1967 | Weller |
| 3,376,624 | A | 4/1968 | Eves |
| 3,442,172 | A | 5/1969 | Lorenz et al. |

(Continued)

FOREIGN PATENT DOCUMENTS

DE 83 953 C 12/1895

(Continued)

OTHER PUBLICATIONS

Corresponding European Patent Application No. 08 831 893.6 supplementary search report dated Aug. 16, 2011.

(Continued)

*Primary Examiner* — Michelle Clement
(74) *Attorney, Agent, or Firm* — Duane Morris LLP; Frank J. Spanitz

(57) ABSTRACT

A chamber reinforcement for composite firearm barrel and method for forming the same. In one embodiment, the barrel includes an inner tube defining a bore that provides a bullet path and an outer sleeve preferably made of a material lighter in weight than the tube. In some embodiments, the inner tube is made of a material that preferably has a greater density and strength than the outer sleeve. The reinforcement in one embodiment may be in the form of an end cap disposed on a portion of the sleeve. The reinforcement preferably is made of a material comparable to the inner tube in density and strength to reinforce the area where a chamber is formed for receiving a cartridge. In the preferred fabrication, the reinforcement, tube, and sleeve are forged together to provide a strong and unitary structure for withstanding combustion pressures and forces associated with discharging the firearm.

24 Claims, 10 Drawing Sheets

U.S. PATENT DOCUMENTS

| | | | |
|---|---|---|---|
| 3,550,502 | A | 12/1970 | Keith |
| 3,863,328 | A | 2/1975 | Arntz |
| 3,943,821 | A | 3/1976 | Seifried |
| 4,075,926 | A | 2/1978 | Eriksson et al. |
| 4,176,487 | A | 12/1979 | Manis |
| 4,409,881 | A | 10/1983 | van der Wielen |
| 4,622,080 | A | 11/1986 | Wegwerth |
| 4,669,212 | A | 6/1987 | Jackson et al. |
| 4,712,465 | A | 12/1987 | Macdonald |
| 4,747,225 | A | 5/1988 | Gstettner et al. |
| 4,756,677 | A | 7/1988 | Hribernik et al. |
| 4,911,060 | A | 3/1990 | Greenspan et al. |
| 5,341,719 | A | 8/1994 | Bullis et al. |
| 5,448,848 | A | 9/1995 | Molier |
| 5,517,540 | A | 5/1996 | Marlowe et al. |
| 5,544,406 | A | 8/1996 | Ridenour et al. |
| 5,856,631 | A | 1/1999 | Julien |
| 5,928,799 | A | 7/1999 | Sherman et al. |
| 5,935,351 | A | 8/1999 | Sherman et al. |
| 6,230,429 | B1 | 5/2001 | Smith |
| 6,497,065 | B1 | 12/2002 | Huston |
| 6,517,126 | B1 | 2/2003 | Peterson et al. |
| 6,564,689 | B1 | 5/2003 | Billgren |
| 6,594,936 | B1 | 7/2003 | Sniezak et al. |
| 6,654,995 | B1 | 12/2003 | Wang et al. |
| 6,691,397 | B2 | 2/2004 | Chakravarti |
| 6,758,004 | B2 | 7/2004 | Huston |
| 6,857,558 | B2 | 2/2005 | Ferry et al. |
| 2004/0149000 | A1 | 8/2004 | Stupecky |
| 2004/0216350 | A1 | 11/2004 | Huston |
| 2007/0164086 | A1 | 7/2007 | Hochhalter et al. |
| 2007/0261286 | A1 | 11/2007 | Briggs |

FOREIGN PATENT DOCUMENTS

| | | |
|---|---|---|
| JP | 61502069 | 9/1986 |

OTHER PUBLICATIONS

Related Korean patent Application No. 10-2008-7023157 Office Action of Oct. 26, 2010.

Related European Application No. 07867001.5-1260/1994356 PCT/US2007004688 extended European search report Aug. 6, 2010 (7 pages).

Related PCT/US07/04688 search report and opinion dated Sep. 5, 2008.

Briggs Vern et al., "Hammer Forged Barrels", Precision Shooting Magazine—Nov. 2005 (vol. 53—No. 7), pp. 1 of 13 at http:technology.calumet.purdue.edu/met/highley/Precisions%20Shooting%20Magazine%2 . . . Apr. 13, 2010).

Corresponding Taiwan Patent Application No. 097125561 Office Action Aug. 16, 2011 and translation.

FIG. 8
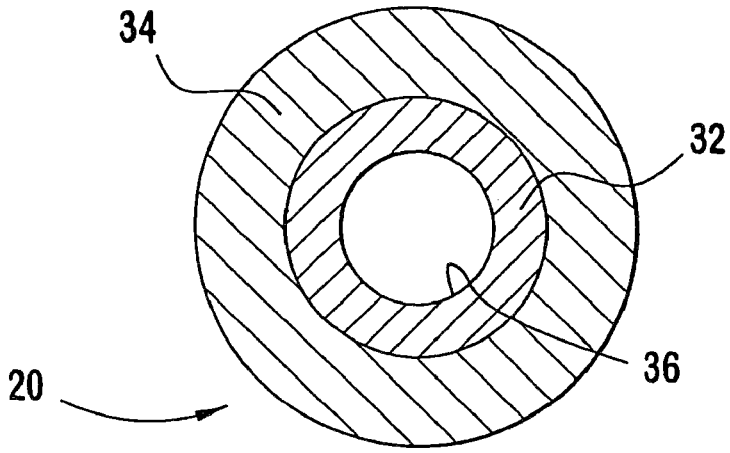
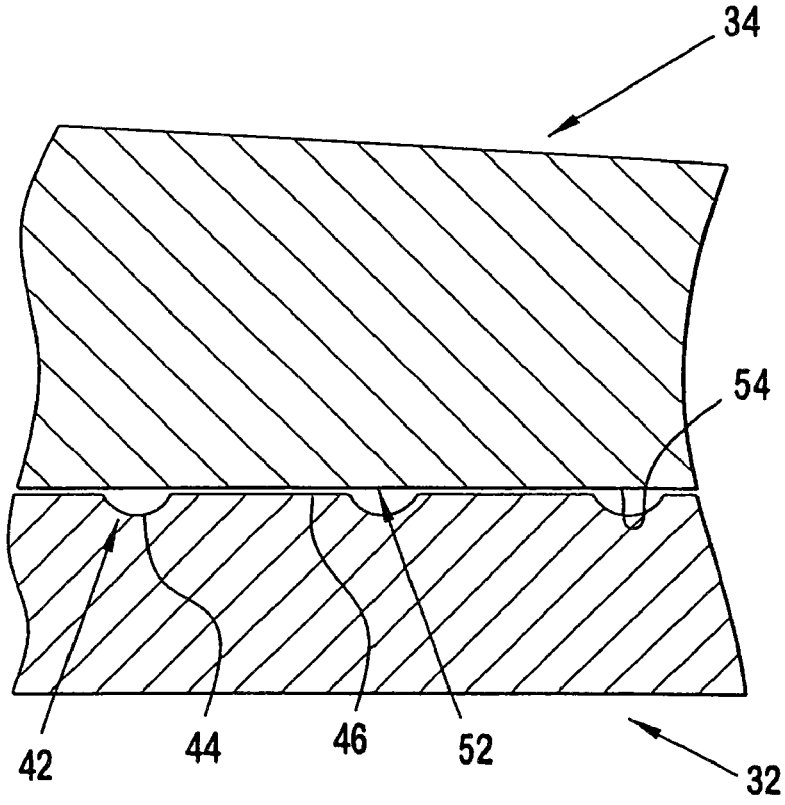
FIG. 9

COMPOSITE FIREARM BARREL REINFORCEMENT

CROSS-REFERENCE TO RELATED APPLICATION

This divisional application claims priority to application Ser. No. 11/879,544 filed Jul. 18, 2007, which is a continuation-in-part of pending prior U.S. patent application Ser. No. 11/360,197 entitled "Composite Firearm Barrel" filed Feb. 23, 2006, which are all incorporated herein by reference in their entireties.

BACKGROUND OF THE INVENTION

The present invention generally relates to firearms, and more particularly to an improved composite firearm barrel having a chamber reinforcement.

The barrel of a firearm is in essence a pressure vessel that is subjected to heat and forces of combustion generated by igniting a cartridge powder charge when the firearm is discharged. Accordingly, steel has been the material of choice for firearm barrels because its mechanical properties allow it to repeatedly withstand numerous cycles of discharging the firearm. But barrels made of entirely steel tend to be heavy, which may make steel-barreled firearms cumbersome to carry for long periods of time or to hold steady during shooting competitions. One attempted solution to produce lighter barrels has been to use aluminum barrels provided with hard-coated or plated bore surfaces for the bullet path. These barrels may be expensive to manufacture and the thinly coated bores surfaces may wear away over time. Composite firearm barrels, defined herein as barrels made of two or more different components, are also known. Some of these barrels include steel inner tubes with outer sleeves or shells made of lighter-weight material, such as aluminum or synthetic plastic resins. Joining the multiple components together to form a secure bond capable of withstanding repeated firearm discharges, however, has been problematic. The outer sleeves have sometimes been attached to the inner steel tubes with adhesives, press-fitting, screwed or threaded connections, sweating or brazing, and by casting. These production techniques may result in composite barrels that may separate over repeated cycles of discharging a firearm due to inadequate bonding or coupling between the inner tubes and outer sleeves or shells. Some known designs may also require multiple fabrication steps and be labor intensive to produce, thereby sometimes making manufacture of these conventional composite barrels complicated and expensive.

Accordingly, there is a need for a light-weight composite barrel that is simple and economical to manufacture, and yet provides a strong and permanent bond between the inner and outer components.

SUMMARY OF THE INVENTION

An improved composite barrel and novel method for forming the same is provided that overcomes the foregoing shortcomings of known composite barrels. In a preferred embodiment, a composite barrel according to principles of the present invention is made by forging which provides a superior and strong bond between the different barrel components in contrast to the foregoing known fabrication techniques. The novel use of the forging method described herein integrates well with existing fabrication processes normally employed in a firearms factory to produce barrels. Therefore, additional and/or more complex fabrication steps and equipment are avoided which advantageously results in efficient and economical manufacturing in contrast to known methods. A composite barrel and method of manufacture as described herein may be utilized for both long barrel rifles and short barrel pistols, with equal advantage in either application.

In one exemplary embodiment, a composite barrel according to principles of the present invention may include an inner tube having a longitudinally-extending bore and a first density, and an outer sleeve having a second density less than the first density of the inner tube, wherein the sleeve is forged to the inner tube. The inner tube may include a plurality of recessed areas on an exterior surface for receiving material displaced from the outer sleeve by forging to bond the tube and sleeve together. In one embodiment, the recessed areas may be in the form of ridges defining grooves both of which extend helically around at least part of the exterior surface and length of the inner tube. In some embodiments, the inner tube is preferably made of steel or steel-alloy and the outer sleeve is preferably is made of a material selected from the group consisting of aluminum, aluminum-alloy, titanium, and titanium-alloy.

In another embodiment, a composite barrel may include an inner tube defining a central bore and including an outer surface having a plurality of recessed areas, and an outer sleeve defining a passageway and including an inner surface. The inner tube preferably is received at least partially in the outer sleeve. The sleeve has a first configuration prior to forging and a second configuration after forging, the first configuration different than the second configuration. In one embodiment, the inner surface of the sleeve has a substantially smooth surface in the first configuration and has a plurality of raised areas in the second configuration. In another embodiment, at least some of the raised areas are received in recessed areas of the inner tube to bond the inner tube and outer sleeve together. The recessed areas of the inner tube are preferably disposed in an exterior surface of the inner tube and in one embodiment may extend circumferentially around at least a portion of the exterior surface. In one exemplary embodiment, the recessed areas of the inner tube are shaped as helical grooves extending at least partially along a length of the tube. In another embodiment, the recessed areas may be in the form of a knurled surface on at least a portion of the outer surface of the inner tube.

In another embodiment, a composite barrel may include an inner tube defining a central bore and including an outer surface having a plurality of recessed areas, the inner tube having a first density, and an outer sleeve defining a passageway and the inner tube received at least partially therein, the sleeve having a second density less than the first density of the inner tube. The sleeve has a first diameter prior to forging and a second diameter after forging, the first diameter larger than the second diameter. The sleeve also has a first length prior to forging and a second length after forging, the second length being longer than the first length.

A method of forming a composite firearm barrel may include: providing an inner tube having a first density; providing an outer sleeve having a second density less than the first density; inserting the inner tube at least partially into the outer tube; impacting forcibly the sleeve in a radially inward direction; and displacing a portion of the outer sleeve to engage the inner tube, wherein the sleeve is bonded to the inner tube to form a composite firearm barrel. In one embodiment, the barrel is formed by forging with a hammer forge.

In another embodiment, a method of forming a composite firearm barrel may include: providing a tube-sleeve assembly including an outer sleeve and an inner tube disposed at least partially therein, the sleeve having inner and outer surfaces, the inner tube having an exterior surface; striking radially the outer surface of the sleeve; and embedding at least a portion of the exterior surface of the inner tube into the inner surface of the sleeve to bond the sleeve to the inner tube.

A method of forming a composite article may include: providing a tube-sleeve assembly including an outer sleeve and an inner tube disposed at least partially therein, the sleeve having inner and outer surfaces, the inner tube having an exterior surface; and forging the tube-sleeve assembly to bond the outer sleeve to the inner tube. In one embodiment, the forging step includes hammering the outer surface of the sleeve in a generally radially inward direction. In one embodiment, the tube is made of steel or steel-alloy and the sleeve is made of a metal selected from the group consisting of aluminum, aluminum-alloy, titanium, and titanium-alloy. In one embodiment, the tube is made of metal having a first density and the sleeve is made of metal having a second density, the first density being different than the second density. Preferably, the second density is less than the first density in a preferred embodiment. The method may further include the step of rotating the tube-sleeve assembly during the forging step. In one embodiment, the tube-sleeve assembly is a firearm barrel.

According to another aspect of a preferred embodiment, an improved composite barrel with a reinforcement is provided for withstanding high cartridge detonation pressures such as those typically associated with some centerfire-type cartridges. In one embodiment, a forged composite firearm barrel includes an inner tube having a longitudinally-extending bore and a first density, an outer sleeve having a second density different than the first density and wherein at least part of the tube is received in a passageway formed in the sleeve, and a reinforcing member joined to the sleeve by forging. In a preferred embodiment, the forging is performed in a hammer forge. In one embodiment, the second density of the outer sleeve is preferably less than the first density of the inner tube. In another embodiment, the reinforcing member has a third density greater than the second density of the sleeve.

In one possible embodiment, the reinforcing member is configured as a cylindrical end cap adapted to be received on or near an end of the sleeve. The composite firearm barrel preferably includes a chamber formed inside the reinforcing member for supporting the chamber during discharge of the firearm. In some embodiments, the inner tube and reinforcing member may be made of a material selected from the group consisting of steel and steel alloy, and the outer sleeve may contain a material selected from the group consisting of aluminum, aluminum-alloy, titanium, and titanium-alloy. In one embodiment, the reinforcing member may be made of a material selected from the group consisting of steel and steel alloy.

In another embodiment, a forged composite firearm barrel with a reinforced chamber includes: an inner tube having a longitudinally-extending bore and a first density; an outer sleeve having a second density less than the first density of the inner tube, the outer sleeve receiving at least part of the inner tube therein; a reinforcing member disposed on the sleeve and having a third density greater than the second density of the outer sleeve; and a chamber for receiving a cartridge and being disposed at least partially inside the reinforcing member for supporting the chamber during discharge of the firearm. Preferably, the tube, sleeve, and reinforcing member are joined together by forging, which in a preferably embodiment is performed in a hammer forge. In one embodiment, at least part of the chamber is formed within the inner tube with a portion of the inner tube being disposed between the chamber and the reinforcing member. In another embodiment, at least a portion of the outer sleeve lies adjacent to at least part of chamber so that the portion of the outer sleeve adjacent to the chamber is supported by the reinforcing member during discharge of the firearm. In one embodiment, the reinforcing member includes an internal cavity receiving an end of the outer sleeve therein; the cavity defining a surface having a plurality of recesses receiving material displaced from the outer sleeve by forging to prevent axial separation of the sleeve and the reinforcing member during discharge of the firearm. In another possible embodiment, the reinforcing member is a cylindrically-shaped end cap adapted for attachment to a receiver of the firearm.

In another embodiment, a reinforced composite firearm barrel formed by forging includes: an inner tube defining a central bore providing a bullet path and including an exterior surface having a plurality of recesses for bonding to the sleeve; an outer sleeve defining a passageway and the inner tube received at least partially in the passageway; a reinforcing member defining an internal cavity and at least partially receiving a portion of the sleeve therein, the cavity including a plurality of recesses for bonding to the sleeve; and a chamber for receiving a cartridge and being disposed within the reinforcing member for strengthening the chamber. Preferably, the inner tube and reinforcing member are bonded to the sleeve via forging, and more preferably by hammer forging in a hammer forge machine.

A method of forming a composite firearm barrel with a reinforcing member is also provided. In one embodiment, the method includes: providing an inner tube having a first density; providing an outer sleeve having a second density less than the first density; inserting the inner tube at least partially into the outer sleeve; placing a reinforcing member on at least a portion of the outer sleeve; impacting forcibly with an object outer surfaces of the sleeve and reinforcing member in a radially inward direction; and displacing a portion of the outer sleeve to engage the inner tube and reinforcing member, wherein the sleeve is bonded to the inner tube and reinforcing member to form a composite firearm barrel. In a preferred embodiment, the barrel is preferably formed by forging and more preferably by using a hammer forge.

In another embodiment, a method of forming a composite firearm barrel includes: providing a tube-sleeve assembly that includes an outer sleeve defining a circumferential exterior surface and an inner tube disposed at least partially in the sleeve; receiving an end of the sleeve in a reinforcing member adapted to engage the sleeve and having a circumferential exterior surface; and striking in radial direction the outer circumferential surfaces of the sleeve and reinforcing member with a plurality of diametrically-opposed objects with sufficient force to deform and bond the sleeve to the inner tube and reinforcing member. In one embodiment, the diametrically-opposed objects are hammers movably supported in a hammer forge.

In another embodiment, a method of forming a composite firearm barrel includes: providing a tube-sleeve assembly including an outer sleeve defining a circumferential exterior surface and an inner tube disposed at least partially in the sleeve; receiving at least partially the sleeve in a cylindrical reinforcing member adapted to engage the sleeve and having a circumferential exterior surface, wherein the reinforcing member and tube-sleeve assembly defines a workpiece; advancing progressively the workpiece from one end to another end through a plurality of diametrically-opposed hammering objects; and striking in a radial direction the outer circumferential surface of the sleeve and reinforcing member with the hammering objects, wherein the sleeve is deformed and bonded to the inner tube and reinforcing member. In a preferred embodiment, the method further includes forming a chamber for receiving a cartridge in the barrel, wherein the chamber lies within the reinforcing member which supports and strengthens the chamber during discharge of the firearm.

In another embodiment, a method of forming a reinforced composite firearm barrel includes: providing a tube-sleeve assembly including an outer sleeve defining a circumferential exterior surface and an inner tube disposed at least partially in the sleeve; receiving at least partially the sleeve in a cylindrical reinforcing member adapted to engage the sleeve and having a circumferential exterior surface, the reinforcing member and tube-sleeve assembly defining a workpiece; forging the workpiece in a hammer forge including a plurality of diametrically-opposed hammers movable to strike the workpiece in a radial direction, wherein the sleeve is deformed and bonded to the inner tube and reinforcing member. In a preferred embodiment, the method further includes forming a chamber for receiving a cartridge in the barrel, wherein the chamber lies within the reinforcing member which supports and strengthens the chamber during discharge of the firearm.

As used herein, any reference to either orientation or direction is intended primarily for the convenience in describing the preferred embodiments and is not intended in any way to limit the scope of the present invention thereto.

BRIEF DESCRIPTION OF THE DRAWINGS

The features of the preferred embodiments will be described with reference to the following drawings where like elements are labeled similarly, and in which:

FIG. 8 is a cross-section taken through the finished barrel of FIG. 1; and FIG. 9 is a partial longitudinal cross-section through the barrel of FIG. 1 prior to forging and showing the inner tube inserted in the outer sleeve;

DESCRIPTION OF THE PREFERRED EMBODIMENTS

In order that the invention may be understood, a preferred embodiment, which is given by way of example only, will now be described with reference to the drawings. The preferred embodiment is described for convenience with reference and without limitation to a firearm barrel for a rifle. However, the principles disclosed herein may be used with equal advantage for a pistol or handgun. According, the invention is not limited in this respect. Moreover, the process for manufacturing composite material parts described herein may equally be employed for making light-weight components other than firearm barrels where weight and manufacturing savings are advantageous, such as in the aerospace industry. Accordingly, the preferred process described herein to make composite articles is not limited to firearm barrel production alone.

Figure 1:
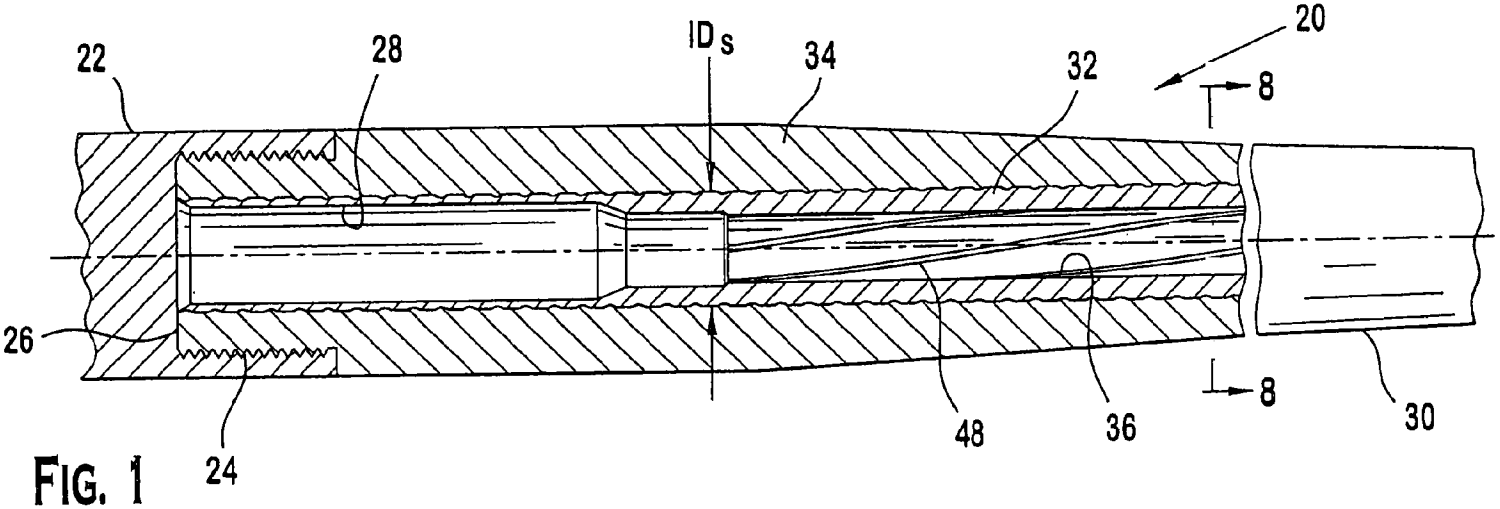
FIG. 1 is a longitudinal cross-section taken through a preferred embodiment of a composite firearm barrel produced in accordance with a preferred method of production described herein, and showing the outer sleeve and inner tube.

Referring now to FIG. 1 which shows a cross-section of a portion of a firearm, a firearm formed according to principles of the present invention in a preferred embodiment generally includes a barrel 20 which may be connected to a receiver 22 via a threaded or unthreaded connection 24 at proximal receiver end 26 of the barrel, as shown. Barrel 20 defines an internal bore 36 which provides a path through which a bullet propelled from a discharged cartridge may travel, a chamber 28 at one end for receiving and holding the cartridge, and a muzzle 30 at a second opposite end from which the bullet ultimately exits the firearm. Bore 36 communicates with chamber 28 and extends through the longitudinal centerline of barrel 20 from chamber 28 through muzzle 30, as shown. Bore 36 defines a longitudinal axis of barrel 20. As shown in FIG. 1, chamber 28 is preferably configured and adapted to compliment the shape of the cartridge. As conventionally practiced in the art, rifling 48 is preferably provided on the surface of bore 36 to impart spin to an exiting bullet for improving accuracy. Rifling 48 may be described as a shallow spiral groove which may be cut or formed in the wall of the bore 36.

Barrel 20 preferably is a composite structure formed from different materials to permit a reduction in total barrel weight to be realized. In the preferred embodiment shown, barrel 20 includes an inner tube 32 and an outer sleeve 34 attached to the inner tube. Preferably, inner tube 32 is made from a metal or metal alloy having sufficient strength and ductility to withstand the heat and pressure forces of combustion created when a cartridge is discharged, such as steel or steel alloy. In some embodiments, inner tube 32 may be made of stainless steel or chrome-moly steel. The tube may be made by drilling roundstock, casting, extrusion, or any other processes conventionally used in the art. Inner tube 32 functions as a liner for outer sleeve 34.

Figure 4:
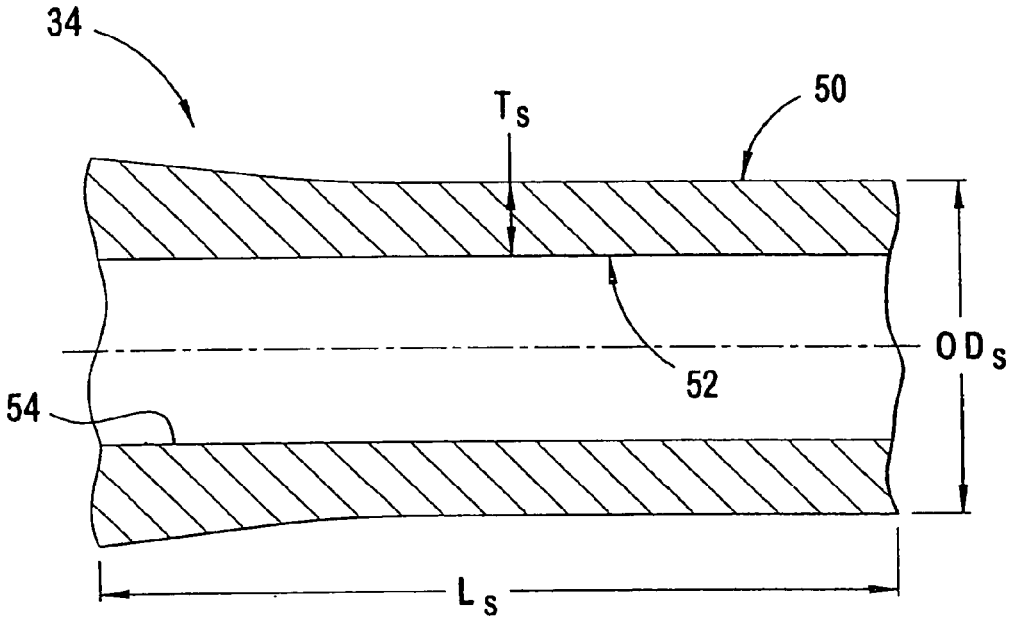
FIG. 4 is a longitudinal cross-section of a portion of the outer sleeve of the barrel of FIG. 1.

Outer sleeve 34 is preferably made of a malleable metal or metal alloy having a weight and density less than the weight and density of inner tube 32 to reduce the combined total weight of barrel 20. Referring also to FIG. 4, sleeve 34 is also preferably in the form of a tube similar to inner tube 32 and has an outside diameter ODs. In a preferred embodiment, outer sleeve 34 is made of aluminum or titanium, or alloys of either aluminum or titanium. Some preferred exemplary aluminums are types T651 and T6511. One preferred exemplary titanium alloy is Ti-6Al-4V. It should be noted that other light-weight metals (e.g., magnesium or magnesium alloys, etc.) are contemplated and may be used so long as the sleeve material has a weight and density less than that of the inner liner tube 32, and are sufficiently malleable for forging and bonding to the inner tube.

A typical representative range of densities for steel or steel alloy which may be used in some embodiments for inner tube 32 is about 7.5-8.1 grams/cubic centimeter, without limitation, depending on the type of steel used and any alloying element content. A typical range for aluminum or aluminum alloy would be about 2.7-2.8 grams/cubic centimeter without limitation. A typical range for titanium or titanium alloy would be about 4.4-4.6 grams/cubic centimeter without limitation. Accordingly, it will be apparent that substituting lower density and concomitantly lighter weight aluminum or titanium for steel to make at least part of the barrel will result in a reduction in weight.

The composite barrel components of the preferred embodiment will now be described in more detail, followed by a description of the preferred method or process of forming the composite barrel.

Figure 2:
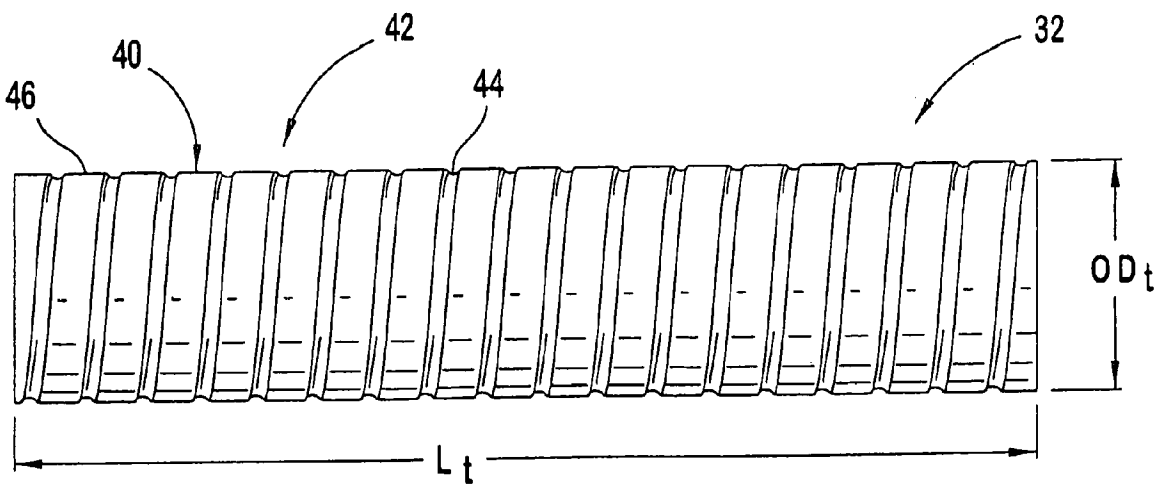
FIG. 2 is a side view of the inner tube of the barrel of FIG. 1 showing one embodiment of a possible exterior surface structure of the tube.

Referring to FIG. 2, inner tube 32 has an exterior surface 40 which preferably is configured to receive material forcibly displaced and protruded from the outer sleeve 34 resulting from the forging process. Preferably, an exterior surface 40 structure including recessed areas such as depressions or cavities are provided therein for that purpose. Accordingly, surface 40 in a preferred embodiment has a combination of raised surface areas and recessed surface areas that function to lockingly engage and secure outer sleeve 34 to inner tube 32, thereby resisting relative longitudinal axial movement between the sleeve and tube when joined or bonded together.

In one embodiment as shown, the exterior surface structure of inner tube 32 may be in the form of helical threading 42 formed on exterior surface 40 of inner tube 32. Threading 42 may include raised helical ridges 46 and lowered helical grooves 44 disposed between successive convolutions of the ridges. The top of ridges 46 define a major diameter for threading 42 and the bottom of grooves 44 define a threading root diameter. Ridges 46 preferably project radially outwards from and above the root diameter of exterior tube surface 40. Ridges 46 preferably may be produced by conventional methods such as cutting grooves 44 into exterior surface 40 of inner tube 32. In other embodiments, the ridges and grooves may be cast into inner tube 32 if the tube is made by casting. Ridges 46 preferably have top surfaces that are shaped to be substantially flat in one embodiment; however, other top shapes such as arcuate, pointed, etc. may be used. The axial side wall surfaces of ridges 46, which also form the walls of grooves 44, may be straight, arcuate, angled, or another shape. Preferably, ridges 46 may have an axial longitudinal width equal to or greater than the axial longitudinal width of grooves 44. Grooves 44 also preferably may have substantially flat, arcuate, or sharply angled bottom surfaces. In one possible embodiment by way of example only, ridges 46 may have a typical width of about 0.09 inches and grooves 44 may have a typical width of about 0.03 inches. However, other widths for ridges 46 and grooves 44 may be provided. Threading 42 may preferably have a typical pitch in some embodiments of about 8 threads/inch to 20 threads/inch, and more preferably about 10 threads/inch to 16 threads/inch.

In contrast to conventional finer screw or machine-type threading characterized by tightly spaced, sharply angled peaks and grooves, the foregoing preferred threading with relatively wide and flat-topped ridges 46 (and widely spaced apart grooves 44) advantageously help the threading resist being completely flattened or squashed in the forging process so that displaced material from outer sleeve 34 may be forced substantially uniformly and deeply into grooves 44 to provide a tight bond between the sleeve and inner tube 32. Producing the preferred threading with wider spaced grooves 44 also advantageously reduces manufacturing time and costs to cut the threads than if conventional threaded were used with tightly spaced peaks and grooves.

Although a preferred threaded exterior surface 40 structure of inner tube 32 is described above, other suitable configurations are contemplated and may be used. For example, conventional threading having sharply angled thread ridges or peaks and V-shaped valleys therebetween may be used (not shown) so long as a groove depth is provided that receives displaced material from outer sleeve 34 by forging sufficient to provide a secure and locking relationship between the sleeve and inner tube 32. Various threading configurations known in the art may be used such as acme, worm, ball, trapezoidal, and others.

Figure 5:
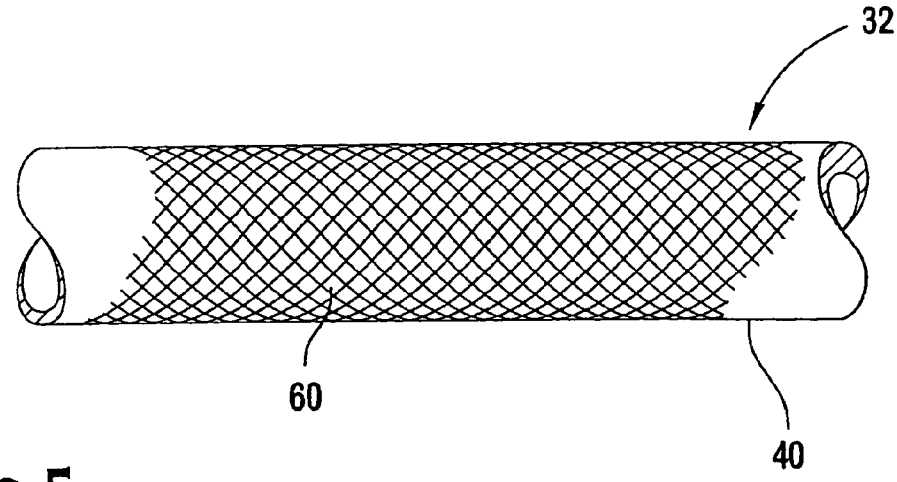
FIG. 5 is a side view of the inner tube of the barrel of FIG. 1 showing another possible embodiment of an exterior surface structure of the tube.

It will be appreciated that the exterior surface 40 may assume numerous other forms or shapes rather than threading so long as recesses or depressions of sufficient depth are provided in exterior surface 40 of inner steel tube 32 to receive deformed material from outer sleeve 34 produced by the forging process. In one alternative embodiment, exterior surface 40 of tube 32 may have a plurality of spaced-apart circumferential grooves 44 shaped similarly to those shown in FIG. 2, but which are not helical and are oriented substantially perpendicular (not shown) to the longitudinal axis of tube 32. In another possible embodiment shown in FIG. 5, recessed areas in the form of knurling 60 may provided on exterior surface 40 in lieu of threading. Furthermore, the exterior surface 40 structure need not be uniform in design or pattern as shown herein, and the recessed areas may be comprised of non-uniform or irregularly shaped random patterns, geometric shapes, or other configurations. This may include simply a sufficiently roughened or pitted exterior surface 40 of inner tube 32 that provide cavities of sufficient depth to longitudinally lock outer sleeve 34 to the tube by forging. In another possible embodiment, although not a preferred embodiment, exterior surface 40 of tube 32 and inner surface 52 of sleeve 34 may be relatively smooth prior to being forged together. It should also be noted that only a portion of exterior surface 40 of tube 32 may be contain recessed areas in other possible embodiments. Therefore, the recessed areas need not be provided along the entire length of inner tube 32 or may be provided in spaced-apart patterns or grouping along the length of the tube. Accordingly, it will be apparent that the invention is not limited to the few examples of possible recessed surface configurations disclosed herein.

Exterior tube threading 42 may preferably, but need not necessarily, be directionally oriented in an opposite direction than rifling 48 in bore 36 (see FIG. 1) which is cut or formed into barrel 20. For example, in a preferred embodiment, threading 42 is left-handed and rifling 48 is right-handed. In other embodiments, threading 42 may be right-handed while rifling 48 is left-handed. During the process of making composite barrel 20 as described in detail below, the use of opposite hand threading for exterior threading 42 and rifling 48 provides added assurance that the attachment of outer sleeve 34 to inner tube 32 is not loosened when the rifling is added to the barrel. In fact, using opposite hand threading would advantageously tend to tighten the connection between outer sleeve 34 and inner tube 32. Alternatively, it will be appreciated exterior tube threading 42 and rifling 48 may have the same hand or directional threading in some embodiments if desired because the bond between outer sleeve 34 and inner tube 32 is primarily formed by forging and material deformation, rather than by a threaded connection alone.

Figure 3:
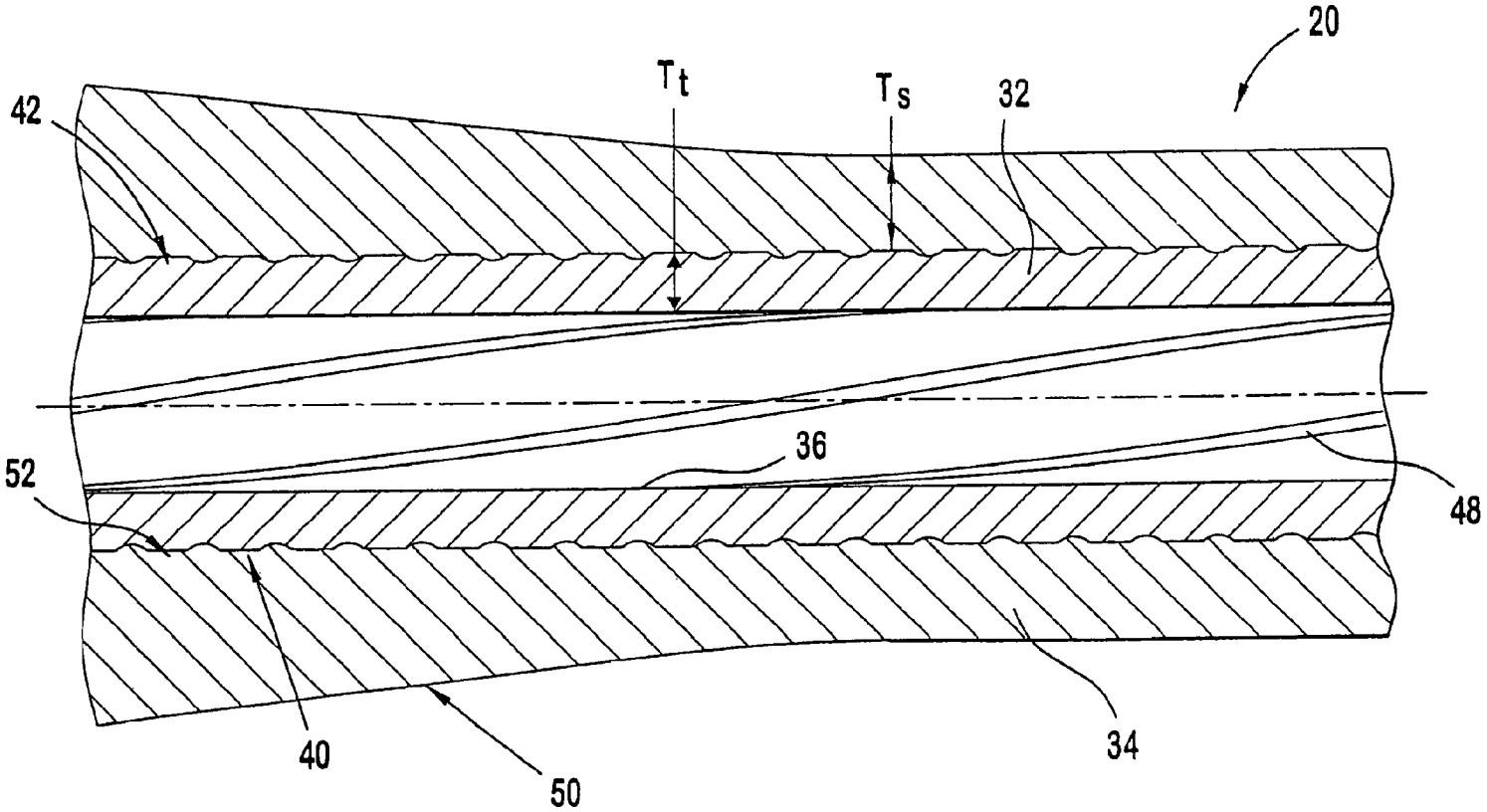
FIG. 3 is a detail view of a portion of the barrel cross-section of FIG. 1.

Referring to FIG. 3, which shows a cross-section through a completed composite barrel formed according to a preferred embodiment, inner tube 32 preferably has a wall thickness Tt that on one hand is sufficient to accommodate cutting rifling 48 therein and to retain suitable strength to absorb the forces associated with discharging a cartridge, while on the other hand is small enough so as to not add undue weight to barrel 20. Outer sleeve 34 preferably has a wall thickness sufficient to make up the desired outside diameter of barrel 20 and to provide any additional strength to the composite barrel that may be required. It will be appreciated that the inner tube 32 and sleeve 34 thicknesses will vary with the size and type of firearm being manufactured and ammunition used, and materials selected for the inner tube and sleeve. Determination of appropriate thicknesses for the desired application and materials are readily within the abilities of those skilled in the art.

The preferred method or process of making a composite barrel according to principles of the present invention will now be described with reference to FIGS. 1-3. Composite barrel 20 is preferably formed by forging, and more preferably by hammer forging using a commercially-available hammer forging machine such as those built by Gesellschaft Fur Fertigungstechnik and Maschinenbau (GFM) in Steyr, Austria. In general, hammer forges conventionally have been used to manufacture one-piece steel barrels in the firearms industry. The conventional process begins with a bored barrel blank that is typically shorter than the desired finished barrel. A mandrel (not shown), which may include the rifling in raised relief on it, is inserted down through the blank in the bore. Since the mandrel essentially sets the minimum final bore diameter of the barrel after forging, the diameter of the mandrel is selected in part based on the desired final bore diameter. The blank is then progressively fed through the machine and hammered around the mandrel by opposing hammers in a process known as rotary forging. This process thins and elongates the barrel to produce a barrel having a finished length and outside diameter longer and smaller than the blank used to begin the process. The rifling is concurrently produced in the barrel bore at the same time. Alternatively, the rifling may be cut into the barrel bore in a separate operation. This same forging machine may be used to produce composite barrels using the method described herein which heretofore has not been used for that purpose. Accordingly, new and additional pieces of machinery for the firearm factory are not required to produce composite barrels according to the principles of the invention which eliminates additional capital expenditures and maintenance/operating costs.

The preferred method of making a composite barrel begins by providing steel barrel blank which may be in the form of round stock. Internal bore 36 may then be formed in the barrel blank by drilling to create the hollow structure of inner steel tube 32 which has an initially plain exterior surface 40. Exterior threading 42 is next cut into exterior surface 40 of tube 32 to provide surface recesses in the form of grooves 44 configured for receiving deformed material of outer sleeve 34 that is displaced from the forging process. Alternatively, however, it will be appreciated that the process may begin by procuring and providing pre-fabricated inner steel tube 32, with either a plain exterior surface 40 or including exterior threading 42. If a plain exterior surface 40 is provided, exterior threading 42 must be cut into the surface.

Outer shell or sleeve 34 is also provided, which preferably is in the form of a tube having an outer surface 50 and passageway 54 defining an inner surface 52 (see FIG. 4). Inner surface 52 preferably may be smooth or slightly roughened since the material is intended to be deformed and forced into the inner tube 32 by forging. Therefore, the inner surface finish is not important so long as the sleeve material may be forced into the recessed areas of the tube exterior surface 40 by the forging process. Preferably, however, inner surface 52 does not have a surface configured with recesses or sunken areas that may interfere with material from sleeve 34 from being relatively uniformly forced into the grooves 44 of inner tube 32 by forging. Outer sleeve 34 preferably has a substantially uniform wall thickness Ts. Outer sleeve 34 may be produced in the same general manner described above for inner tube 32, or by extrusion or other techniques commonly used in the art of metal component fabrication. In a preferred embodiment, outer sleeve 34 is preferably made of aluminum, titanium, or alloys of either aluminum or titanium; however, other suitable light-weight metals or metal alloys may be used provided they have sufficient malleability to undergo deformation during the forging process to fill grooves 44 in inner tube 32 (see FIG. 2).

The barrel forming process continues by inserting inner tube 32 into outer sleeve 34. This places the inner surface 52 of outer sleeve 34 proximate to exterior surface 40 of inner tube 32, but not necessarily contacting the inner tube at all places along the length and circumference of the sleeve and inner tube. The outside diameter $OD_T$ of inner steel liner tube 32 (FIG. 2) is preferably slightly smaller than the inside diameter $ID_s$ of outer sleeve 34 (FIG. 1) so that the tube may slide into the outer sleeve. A relatively close fit and somewhat tight dimensional tolerances between inner tube 32 and outer sleeve 34 before forging is preferred, but not essential, so long as outer sleeve 34 is proximate to and may be forced thoroughly into grooves 44 of steel tube 32 to produce a secure bond during the hammer forging process.

It will be noted that tube-sleeve assembly 32, 34 has a first initial or prefabrication configuration and size prior to forging. Referring to FIGS. 4 and 9 showing sleeve 34 (the latter which shows a partial cross section through a portion of inner tube 32 inserted inside outer sleeve 34 before forging), outer sleeve inner surface 52 of sleeve passageway 54 preferably is relatively uniform and smooth without any substantial surface structures protruding radially therefrom or recessed therein that might interfere with forming a good bond between the tube and outer sleeve by forging. Inner tube 32 in a preferred embodiment may be as shown in FIG. 2 with exterior threading 42 and a relatively smooth bore 36 (not shown).

Figure 6:
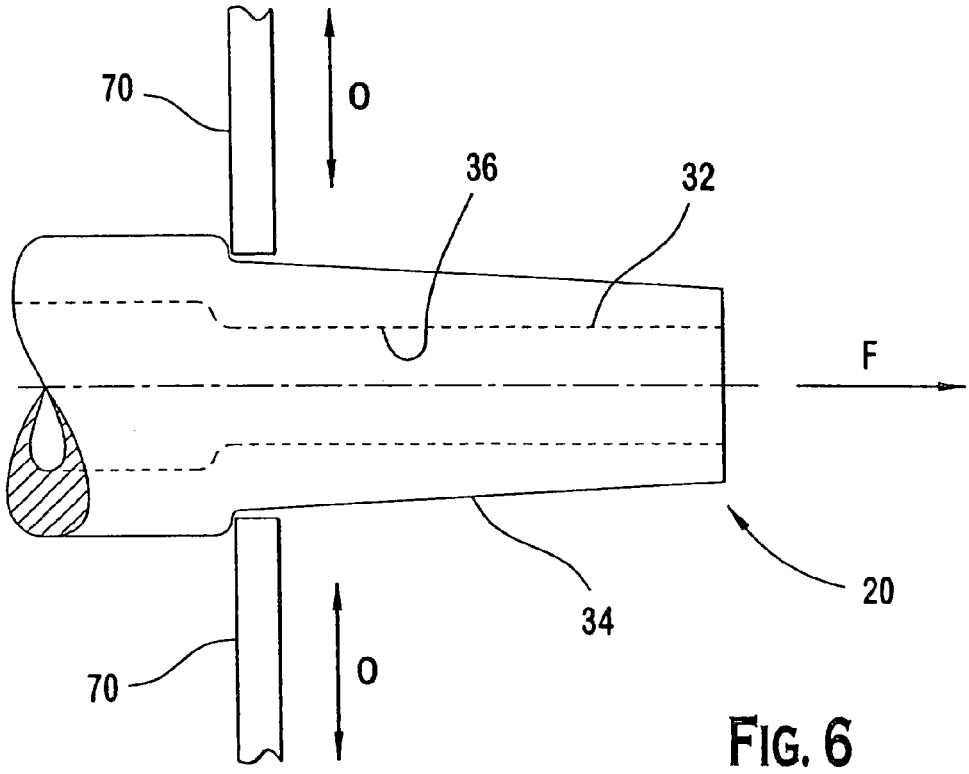
FIG. 6 is a side view of the barrel of FIG. 1 showing its progression from original pre-forged form to final post-forged form as it is fed through the preferred fabrication process using a hammer forging machine.

Referring to FIG. 6, the tube-sleeve assembly 32, 34 is next loaded into the hammer forging machine. A hammer forge mandrel (not shown) is inserted through bore 36 of tube 32, and the tube-sleeve assembly 32, 34 with mandrel inserted therein is advanced in an axial direction F into the forging machine. Both the mandrel and tube-sleeve assembly 32, 34 are simultaneously rotated by the forging machine while being moved axially forward in the machine. Tube-sleeve assembly 32, 34 continues to advance towards the forging section of the machine and through diametrically-opposed oscillating impact or striking members such as hammers 70 which strike and contact (i.e., "hammer") the outer surface of sleeve 34 with substantial force. This process is known also as rotary forging. Hammers 70 oscillate back and forth at an extremely high rate of speed in a direction O, which preferably is generally perpendicular to the workpiece surface such as outer surface 50 of sleeve 34.

In one embodiment, the forging machine may contain four hammers 70 (shown diagrammatically in FIG. 6 in side elevation view) with two-pairs each being diametrically-opposed by an angle of 180 degrees. In FIG. 6, the vertical pair of opposed hammers 70 are shown while the horizontal pair of hammers are omitted for clarity of depicting the tube-sleeve assembly 32, 34. The supporting structure for the hammers, other component details of the hammer forging machine, and operation thereof may be readily determined by those skilled in the art by reference to the forging machine manufacturer's operating and maintenance manuals. Accordingly, for the sake of brevity, these aspects of the forging machine and references are not duplicated herein. It will be noted that the axial feed rate and rotational speed (RPM) of the tube-sleeve assembly 32, 34 may be adjusted and optimized as required by the forging machine user based on the diameter of the assembly and wall thickness of the components to achieve a good bond between the tube and sleeve. This may easily be determined by those skilled in the art through routine trial runs with barrel materials with reference to the forging machine manufacturer's manuals.

Figure 7:
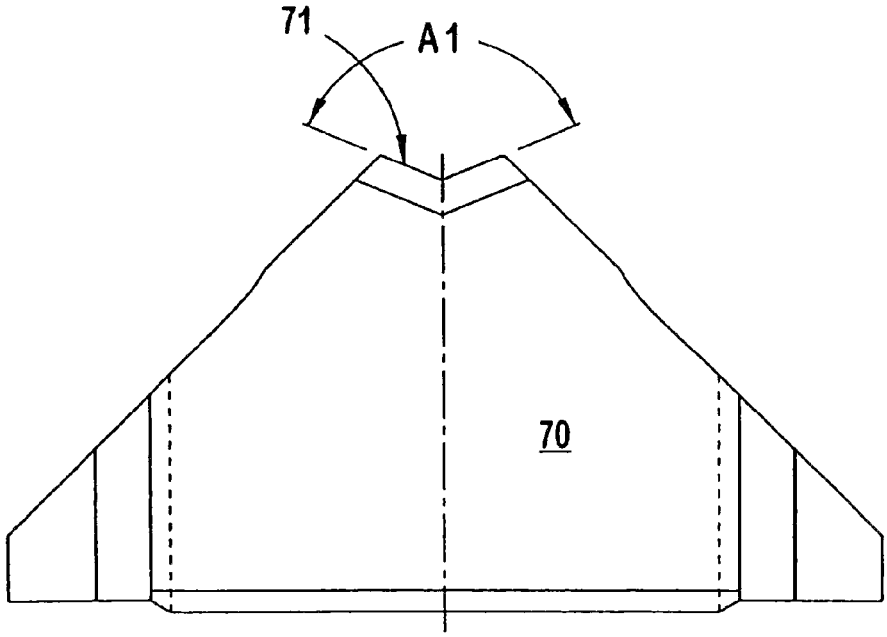
FIG. 7 is a front view of one of the forging hammers of FIG. 6.

FIG. 7 shows a front elevation view of a typical hammer from FIG. 6 (viewed axially along tube-sleeve assembly 32, 34 in feed direction F of the forging machine). Each hammer 70 may be generally triangular in shape in one embodiment and have a striking surface 71 which strikes and deforms the workpiece such as tube-sleeve assembly 32, 34. Striking surface 71 in some embodiments may be slightly radiused and/or angled forming a striking surface angle Al as shown to compliment the generally round cross section of the workpiece. Angle Al may typically be about 135 degrees to about 155 degrees in some embodiments, but may be smaller or larger than that range depending on the diameter of the tube-sleeve assembly 32, 34. Varying angle Al can be used to produce differing types of aesthetic surface finishes from very smooth where the hammer marks on outer surface 50 of sleeve 34 may not be readily noticeable, to a rougher finish in which the hammer marks are intentionally noticeable. Accordingly, angle Al is not limited to the foregoing range.

It should be noted that the invention is not limited by type of commercial forging machine used, the position or number of forging hammers used, or individual configuration or details of the hammers themselves. Any type of hammer forging machine or other suitable type of forging apparatus and operation can be used so long as the outer sleeve may be deformed and bonded to the inner tube in the same or equivalent manner described herein.

Referring again to FIG. 6, tube-sleeve assembly 32, 34 continues to be fed axially and advanced through the hammer forge. The impact hammers 70 strike outer surface 50 of sleeve 34 with tremendous force that progressively hammers the tube-sleeve assembly around the forging mandrel. Hammer 70 preferably strike sleeve 34 approximately perpendicular to outer surface 50 and in a radially inwards direction. This radially compresses and deforms sleeve 34 which is essentially squeezed between the mandrel and inner tube 32 on the inside, and the hammers 70 on the outside which circumferentially constrain the sleeve. The hammering causes material from inner surface 52 of the sleeve to be displaced and forced to flow into the cavities or recessed areas of the inner tube exterior surface 40, such as grooves 44. The displaced material from outer sleeve 34 becomes embedded in grooves 44 such that the sleeve engages the grooves of inner tube 32 to join the sleeve and tube together. Preferably, material from sleeve 34 fills at least part of the depth of grooves 44. More preferably, substantially the entire depth of grooves 44 are filled with embedded material from outer sleeve 34. The forging operation also causes material from sleeve 34 to flow in a longitudinal direction, which becomes longer in length after forging than before. Barrel 20 is essentially squeezed off the mandrel as it progresses through the oscillating hammers. It should be noted that alternatively, the forging operation may conversely be viewed from the perspective of the inner tube as depressing ridges 44 into inner surface 52 of the outer sleeve 34, thereby forming depressions in the sleeve corresponding to the ridges 44 of the tube.

As shown in FIG. 6, tube-sleeve assembly 32, 34 undergoes a physical transformation in terms of size during the forging process, thereby resulting in a second final size that is different than the assembly's first initial prefabrication size. Tube-sleeve assembly 32, 34 is generally reduced in diameter and longitudinally elongated or increased in length as the assembly moves through the hammers 70 and material is displaced. The combined tube-sleeve assembly may be elongated in length by about 15% or more. Accordingly, after forging, the final outside diameter ODs of outer sleeve 34 is smaller than the beginning outside diameter ODs. Sleeve wall thickness Ts also becomes smaller than its initial thickness. And sleeve length Ls (see FIG. 4) becomes longer after the forging process. Length Lt of inner tube 32 becomes longer than its first prefabrication length after forging. Outside diameter ODt and wall thickness Tt undergo a reduction in size and become smaller.

By way of example, in one trial production of a composite barrel for a 22 caliber rimfire rifle using a hammer forging machine, the following dimensional transformations resulted with a barrel having a steel inner tube 32 and titanium outer sleeve 34. Before forging, inner tube 32 had an initial ODt of 0.375 inches and an IDt of 0.245 inches. After forging, tube 32 had a final outside diameter ODt of 0.325 inches and an IDt of 0.2175 inches (final IDt based on desired bore diameter and selection of suitable mandrel diameter necessary to produce the desired bore diameter). Accordingly, a reduction of approximately 13% in diameter resulted from forging based on the outside diameter ODt of tube 32. Concomitantly, this also resulted in a growth in length Lt of tube 32 by about 13% as tube material compressed and displaced by forging results in a longitudinal displacement of material and elongation of the tube. The mandrel and mechanical properties of the steel essentially limits in part the inwards radial displacement of tube material and reduction in diameter, which then forces material to be displaced in a longitudinal direction instead. It will be appreciated that a reduction in wall thickness Tt of tube 32 may concomitantly occur during the forging process (about 0.02 inches in the above example).

Before forging, outer sleeve 34 in the same 22 caliber rifle trial production had an initial ODs of 1.120 inches and an IDs of 0.378 inches. After forging, sleeve 34 had a final outside diameter ODs of 0.947 inches and an IDs of about 0.325 inches. Accordingly, a reduction of approximately 15% in diameter resulted from forging based on the outside diameter ODs of sleeve 34. Concomitantly, this also resulted in a growth in length Ls of sleeve 34 by about 15% as sleeve material compressed and displaced by forging results in a longitudinal displacement of material and elongation of the sleeve. Inner tube 32 and mechanical properties of the titanium essentially limits in part the maximum inwards radial displacement of sleeve material and reduction in diameter, which then forces material to be displaced in a longitudinal direction instead. It will be appreciated that a reduction in wall thickness Ts of sleeve 34 may concomitantly occur during the forging process (about 0.12 inches in the above example).

During the forging operation, in addition to the foregoing dimensional changes that occur, outer sleeve 34 also concomitantly undergoes a transformation in configuration or shape. After forging, inner surface 52 of sleeve 34 is reshaped being now characterized by a series of helical raised ridges and recessed grooves which are substantially a reverse image of the ridges 46 and grooves 44 of inner tube 32. This results from the deformation of outer sleeve 34 by forging which forces its material to flow into ridges 46 and grooves 44 of inner tube 32 to permanently bond the sleeve and tube together. Accordingly, in contrast to known composite barrel fabrication techniques used heretofore, the final reconfigured composite barrel according to principles of the present invention advantageously derives a strong and secure bond from this reshaping transformation. In addition, in contrast to barrel liners having cast-on sleeves, the forged composite barrel of the present invention has superior strength.

At the same time tube-sleeve assembly 32, 34 is forged, rifling 48 may optionally be hammered in bore 36 of inner tube 32 if a mandrel with rifling in raised relief as described above is provided. Alternatively, rifling may added to bore 36 by cutting or cold forming by pulling a rotating button with raised lands mounted on a long rod of a hydraulic ram through the barrel bore. After outer sleeve 34 has been bonded to inner tube 32, any final machining or finishing steps, such as grinding, polishing, machining a chamber in the barrel, etc. may then be completed to tube-sleeve assembly 32, 34 as required.

The forging process and resulting material deformation produces a strong and secure bond between tube 32 and outer tube 34 to the extent that the materials of the two components are virtually fused together into a single bi-metal component such that the interface between the inner tube and outer sleeve materials may become almost unperceivable. The reformed composite barrel thus avoids potential looseness between the joined barrel components which could otherwise vibrate and possibly separate after repeated cycles of discharging the firearm. It should be noted that the material from outer sleeve 34 need not be completely forced by forging into every portion of inner tube helical groove 44 so long as a sufficient circumferential and longitudinal extent of the groove is filled with sleeve material to provide a strong bond between the barrel components. Accordingly, some portions of the barrel 20 where the bond is not perfect is acceptable.

The forging process advantageously produces a light-weight and strong composite barrel having a bond between the two components that is superior in strength and durability to conventional methods of bonding different barrel components together as described above. These conventional methods do not structurally reform and reshape the component materials, but merely attempt to mechanically couple the barrel components together without altering their structure or shape. And in contrast to conventional composite barrel constructions using two threaded components that are essentially just screwed together, a composite barrel made by the foregoing forging process fuses the materials together which cannot be unscrewed or loosened, either manually or by vibration induced through discharging the firearm. Accordingly, the composite barrel of the present invention will not loosen and rattle over time. In addition, the hammer forging process advantageously produces the bond in a single operation using existing firearm factory equipment which already is used for working and producing other firearm components, such as all-steel barrels. Accordingly, production economies and efficiencies may be realized.

As an example, a typical weight reduction which may be achieved for a composite rifle barrel formed according to principles of the present invention in contrast to an all steel barrel of the same dimensions is in the range of about 7-8 pounds using an aluminum outer sleeve and 4-5 pounds using a titanium outer sleeve.

It should be noted that the type of materials and wall thicknesses used for the tube and sleeve, together with the tube-sleeve assembly 32, 34 feed rate through the hammer forge and RPM of the mandrel determines the forging force and resulting strength of the bond between the tube and sleeve. Based on experience with using hammer forge machines in producing conventional one-piece steel barrels, it is well within the abilities of one skilled in the art to optimize the foregoing parameters for producing a satisfactory bond between the tube and sleeve. It will also be appreciated that the initial pre-forged OD and wall thicknesses of the tube and sleeve necessary to produce a final forged composite barrel of the proper dimensions will vary based on the caliber of the firearm barrel intended to be produced.

The foregoing forging process may be used to fabricate composite long or short barrels for either rifles or pistols, respectively. In addition, it is contemplated that more than two materials may be bonded together to produce composite barrels, or other articles unrelated to firearms, using the forging process and principles of the present invention. For example, it may be desirable to construct an article having a strong, hard inner tube and lighter-weight sleeve as already described herein, but with a strong hard outermost shell on top of the sleeve for better impact resistance. In one such possible embodiment, this construction may include a steel inner tube and thin steel outermost shell, with an aluminum or titanium sleeve disposed therebetween. Accordingly, there are numerous variations of multiple material composite articles that are contemplated and may be produced according to the principles of the present invention described herein.

According to another aspect of the invention, the foregoing process may used to create composite parts for numerous applications unrelated to firearms where it is desirable to have the stronger and more dense material on the outside of the composite tubular structure for various reasons, such as impact resistance to exteriorly applied loads. In essence, this construction is the reverse of the exemplary firearm barrel construction described above. In one possible embodiment, therefore, such a composite structure may include a lower density inner tube made of aluminum, titanium, or alloys thereof, and a higher density outer sleeve made of steel. These components may be configured the same way as inner tube 32 and outer sleeve 34 described above, but merely reversing the lighter and heavier materials in position for the inner tube and outer sleeve. The components of the composite part may then be bonded together via hammer forging in a manner similar to that described above for tube-sleeve assembly 32, 34. Such constructions may be advantageously used in the aviation and aerospace industries where strong, yet light-weight tubular constructions are beneficial.

According to another aspect of the invention, a composite barrel 20 is provided that includes a reinforcing member to reinforce chamber 28 near proximal receiver end 26 of the barrel. The reinforcing member reinforces and provides additional strength to the chamber area of barrel 20 to better withstand higher combustion pressures and forces associated with firing some types and/or calibers of ammunition, such as centerfire cartridges for example. Centerfire cartridges are typically used today for calibers larger than 0.22 and thus generate higher combustion pressures than rimfire-type cartridges still commonly used for smaller 0.22 caliber cartridges. The reinforcing member in a preferred embodiment is hammer forged simultaneously with the composite barrel to form a unitary and strong structure as described herein.

Figure 10:
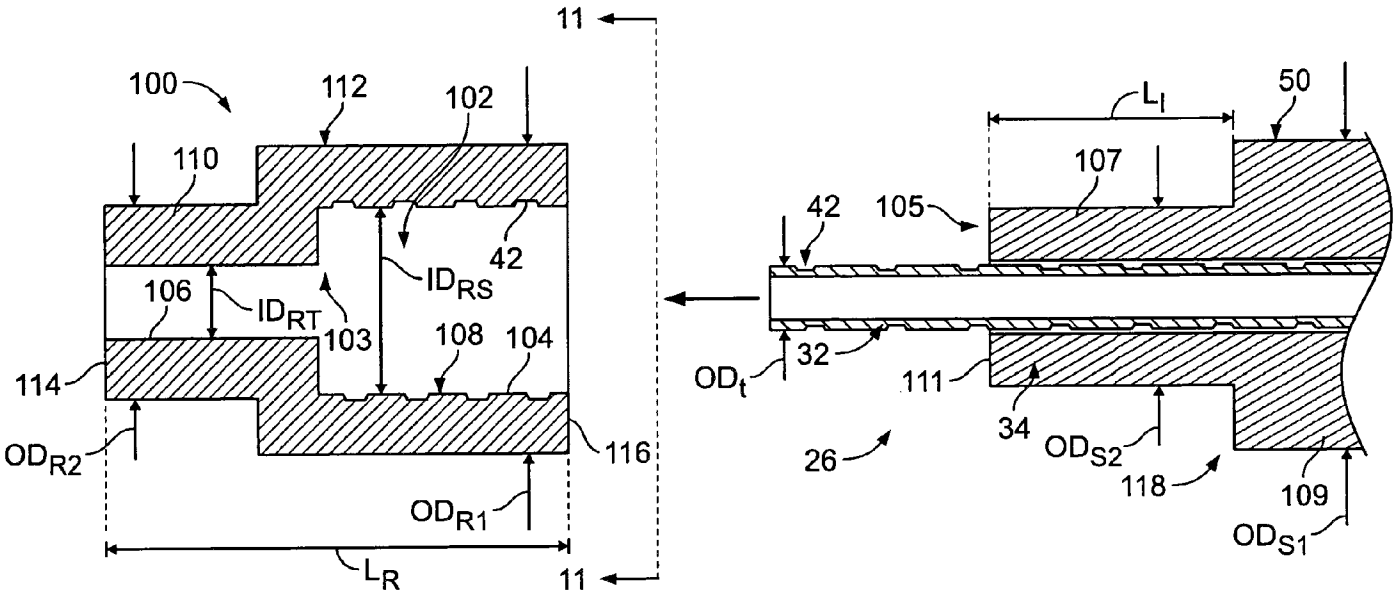
FIG. 10 is cross-sectional view of a reinforcing member for the composite firearm barrel of FIG. 1 in an exploded view with a portion of the tube-sleeve assembly.
Figure 11:
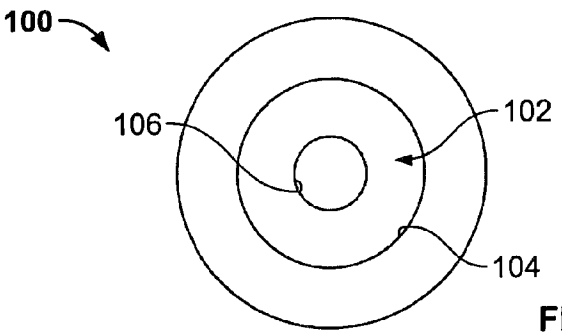
FIG. 11 is end view of the reinforcing member taken along line 11-11 in FIG. 10.

FIGS. 10 and 11 shows one possible embodiment of a reinforcing member which may be in the form of a reinforcing end cap 100 that configured and adapted to fit on receiver end 26 of composite barrel 20 where chamber 28 will be formed. Accordingly, receiver end 26 preferably has an end preparation that complements end cap 100 in size and configuration to receive the end cap thereon, as explained herein. FIG. 10 shows the end cap 100 and tube-shell assembly 32, 34 defined by inner tube 32 and outer sleeve 34 before assembly and hammer forging of any of the components, and prior to formation of the cartridge chamber therein. End cap 100 is shown prior to be placed on receiver end 26 of tube-sleeve assembly 32, 34 and is insertable thereon.

Figure 12:
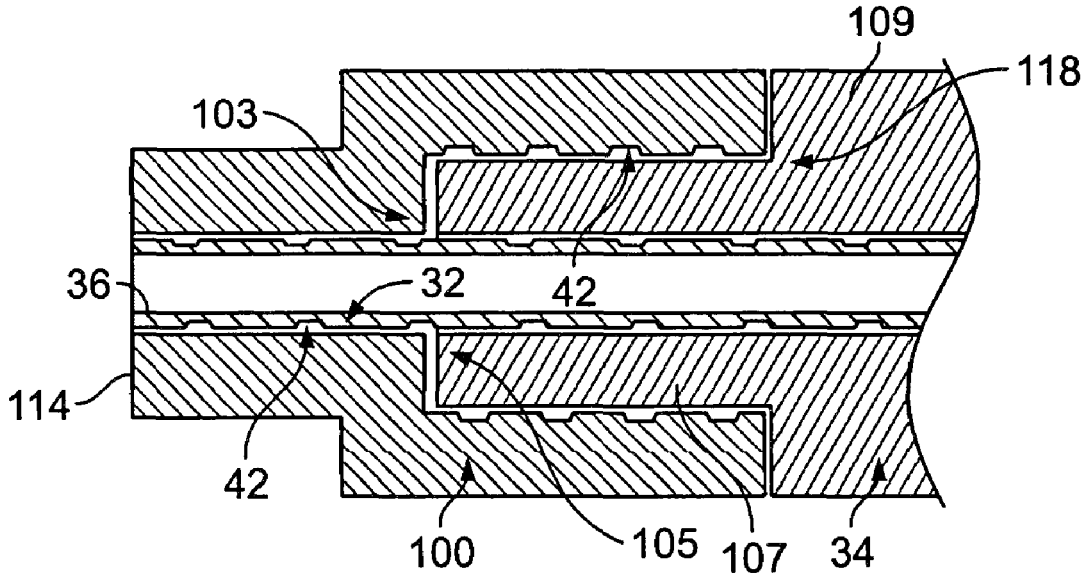
FIG. 12 is a cross-sectional view of the foregoing reinforcing member and tube-sleeve assembly prior to forging.

Referring to FIG. 10, receiver end 26 of composite barrel 20 in one embodiment may be configured with inner tube 32 extending beyond the end of outer sleeve 34 to define a shoulder 105 configured to abut and mate with corresponding shoulder 103 in end cap 100 (see FIG. 12). Inner tube 32 preferably has an outer diameter $OD_t$ sized to be received in end cap 100. Inner tube 32 may be of the same construction as already described elsewhere herein. Accordingly, inner tube 32 in one embodiment preferably includes threading 42 (see, e.g. FIG. 2) or other surface recesses to receive material displaced from outer sleeve 34 during hammer forging.

Outer sleeve 34 may be provided in one possible embodiment with an outer shoulder 118 defined by a stepped outer circumferential surface 50 having a portion with a first outer diameter $OD_{s1}$ and a portion with second outer diameter $OD_{s2}$ that preferably is smaller than the first outer diameter. Shoulder 118 is configured to abut end 116 of reinforcing end cap 100 when the tube-tube assembly 32, 34 is inserted therein (see FIG. 12).

Referring to FIGS. 10 and 11, reinforcing end cap 100 may be a generally cylindrical hollow or tube-like structure in shape having a length $L_R$ and an internal cavity 102 preferably extending completely through the end cap from one end 114 to an opposite end 116 for receiving a cartridge. In one embodiment, cavity 102 is formed with a shoulder 103 defined by a stepped inner surface 108 created by a large first cavity 104 defining an inner diameter $ID_{RS}$ and an adjoining smaller second cavity 106 defining a smaller second inner diameter $ID_{RT}$ that communicates with the first cavity. Cavities 106 and 104 in one embodiment are preferably sized and configured to receive at least part of inner tube 32 and outer sleeve 34, respectively.

Continuing with reference to FIGS. 10 and 11, reinforcing end cap 100 includes an outer circumferential surface 112. In some embodiments, end cap 100 may include a receiver connection 110 for attaching the completed composite barrel 20 to receiver 22 of a firearm. Receiver connection 110 may have any suitable configuration for being secured to receiver 22 by conventional methods (e.g., threaded, plain, slotted, a combination thereof, etc.) depending on the type of system selected to attach composite barrel 20 to the receiver. In one possible embodiment as shown in FIG. 10, receiver connection 110 may be a reduced diameter section of end cap 100. Accordingly, receiver connection 110 in some embodiments may have an outer diameter $OD_{R2}$ smaller than $OD_{R1}$ to define a stepped transition in outer surface 112 of end cap 100. It should be noted that receiver connection 110 may be machined to produce the reduced diameter $OD_{R2}$ profile shown and any other needed appurtenances after hammer forging of composite barrel 20 is completed. In other embodiments contemplated, outer surface 112 may not be stepped such that receiver connection 110 may not have a reduced diameter $OD_{R2}$ but rather will be the same as outside diameter $OD_{R1}$.

Referring still to FIGS. 10 and 11, inner surface 108 in a preferred embodiment may include threading similar to threading 42 of inner tube 32 or other types of surface recesses described herein to form a tight bond between tube-sleeve assembly 32, 34 and end cap 100 when the two components are hammer forged together, thereby forcing material from sleeve 34 to flow into recesses formed in inner surface 108. Since the material of sleeve 34 preferably is more malleable than the material used to fabricate end cap 100, the bond formed between these two components after hammer forging will advantageously be strengthened to better withstand forces associated with discharging the firearm without axial separation in the direction of the longitudinal axis LA. As shown for example in FIGS. 13A and 13B, longitudinal axis LA is defined by tube-sleeve assembly 32, 34. Preferably, portions of outer sleeve 34 intended to receive end cap 100 are not threaded and have a relatively smooth surface to promote uniform flow of sleeve material into threading 42 (or other types of surface recesses that may be provided) along the inner surface 108 of the end cap. Although inner surface 108 of end cap 100 may include surfaces recesses as shown, in other embodiments (not shown) inner surface 108 may be provided without any such recesses and may be smooth or plain.

Preferably, reinforcing end cap 100 is made of a material with greater mechanical strength and ductility than outer sleeve 34 to withstand the forces and pressures of combustion associated with discharging the firearm. Accordingly, in one embodiment end cap 100 preferably has a greater weight and density than outer sleeve 34 whose preferably lighter-weight and strength material is selected to reduce the weight of barrel 20. Material for outer sleeve 34 is preferably more malleable as described to bond with end cap 100 and inner tube 32 during hammer forging. As described herein, in some preferred embodiments, outer sleeve 34 may be made of aluminum, aluminum alloy, titanium, or titanium alloy as described herein having significantly lower densities. In some possible embodiments, end cap 100 may be made of the same material as inner tube 32; however, the end cap may be made of a different material. In some exemplary embodiments, end cap 100 preferably may be made of steel or steel alloy including stainless steel such as for example AISI Type 410 stainless having a representative density of about 7.8 grams/cubic centimeter. In other exemplary embodiments, end cap 100 may be a carbon steel such as for example AISI Type 1137 carbon steel having a representative density of about 7.7-8.0 grams/cubic centimeter. Although steel and steel alloys are preferred, it will be appreciated that any suitable material may be selected for reinforcing end cap 100 so long as the material has sufficient strength and toughness to withstand the forces and pressures associated with discharging the firearm.

Depending on the type of material selected and service conditions anticipated, reinforcing end cap 100 may be formed by any suitable method, such as but not limited to conventional forging, casting, machining, and combinations thereof. Any threading or the addition of surface recess on inner surface 108 of end cap 100 described above may be made simultaneously with the production of the end cap or complete afterwards by a suitable machining or forming process.

In a preferred embodiment, end cap 100 may be hardened by heat treatment/induction hardening for increased impact resistance to being struck by the bolt (not shown) following discharge of the firearm and recoil of the bolt.

A preferred method of forming a composite barrel 20 with a reinforcing member will now be described with reference to FIGS. 10-13. During an initial step, reinforcing end cap 10, inner tube 32, and outer sleeve 34 are prefabricated in a manner described above and provided as separate components for pre-forging assembly. In one embodiment, the pre-forging assembly may be prepared as follows. Tube 32 may first be inserted into sleeve 34 to create the tube-sleeve assembly 32, 34 shown in FIG. 9. End cap 100 may next be placed onto the receiver end 26 of tube-sleeve assembly 32, 34 to complete the pre-forging assembly shown in FIG. 12, which defines a workpiece. The sequence in which end cap 100, tube 32, and sleeve 34 are assembled before forging may be varied and conducted in any order so long as the pre-forging assembly shown in FIG. 12 is produced.

Figure 13A:
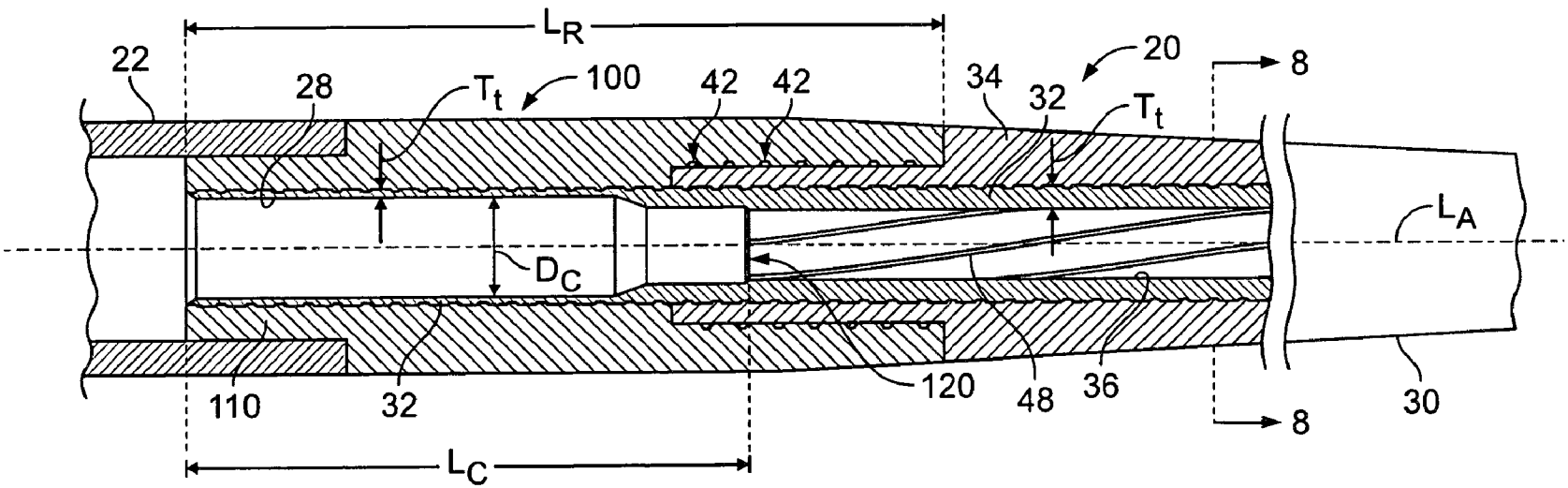
FIG. 13A is cross-sectional view of the foregoing reinforcing member and tube-sleeve assembly after forging and formation of the chamber therein.
Figure 13B:
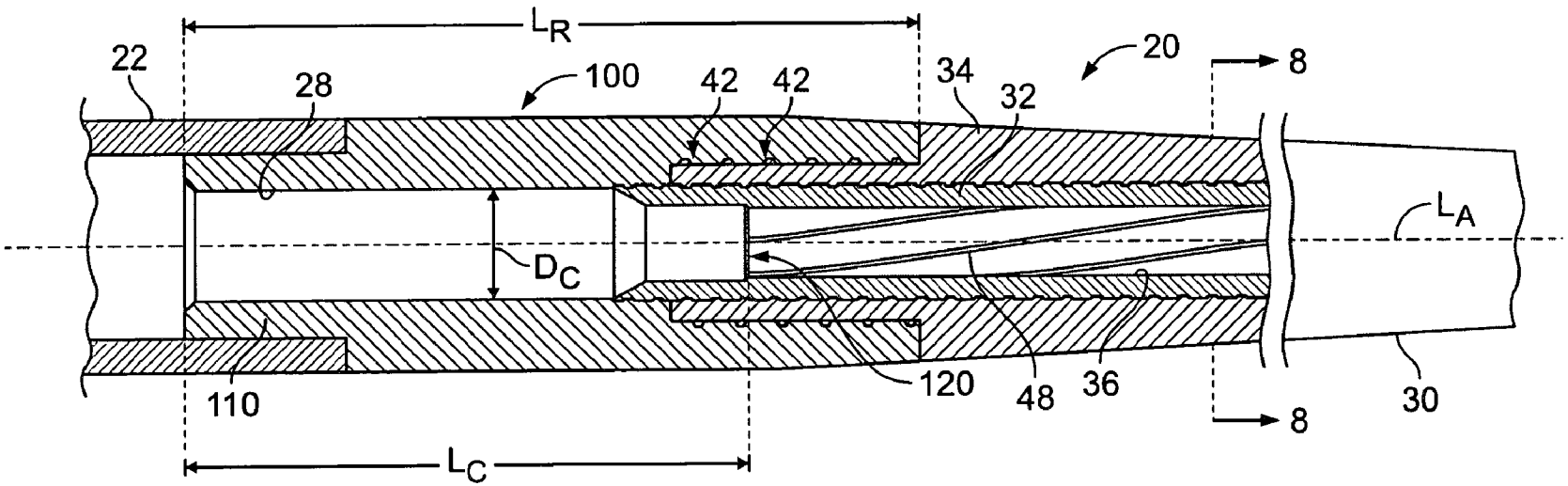
FIG. 13B is cross-sectional view of an alternative embodiment of the foregoing reinforcing member and tube-sleeve assembly after forging and formation of the chamber therein.

In the next step, the workpiece comprising end cap 100 and tube-sleeve assembly 32, 34 as shown in FIG. 12 is then processed through the hammer forging machine in the same manner previously described herein for tube-sleeve assembly 32, 34 alone. In short, the workpiece is supported by the mandrel and progressively advanced forward through the hammer forge starting at one end until the other end of the workpiece is reached. The oscillating hammers of the hammer forge strike the outer circumferential surface of the end cap 100 and sleeve 34 in a radial inwards direction along the length of the workpiece, thereby deforming the workpiece and bonding the sleeve to the end cap and inner tube 32 to form a unitary composite structure. A hammer-forged composite barrel 20 with reinforcing end cap 100 as shown in FIG. 13A or 13B may thus be produced. End cap 100 encapsulates a portion of sleeve 34 (for example, in the area near the muzzle end 120 of chamber 28) which becomes sandwiched between inner tube 32 and the end cap, thereby advantageously reinforcing and strengthening the sleeve in this area to better withstand the pressures and forces of combustion associated with discharging the firearm. In the forging process, end cap 100 is preferably irreversibly fused or bonded onto and becomes integral with the entire tube-sleeve assembly 32, 34 to produce a monolithically strong structure of all three components. Thus, in a preferred embodiment, end cap 100 is permanently bonded to sleeve 34 by the forging process and cannot be non-destructively removed from tube-sleeve assembly 32, 34 without damaging the assembly and end cap. Unlike composite structures assembled by mechanical fastening techniques which can be reversed and disassembled, end cap 100 and tube-sleeve assembly 32, 34 advantageously is permanently joined to better withstand the cyclical stresses associated with repeatedly discharging the firearm without component separation during the useful life of the firearm.

Chamber 28 may be formed in tube-sleeve assembly 32, 34 by any suitable method, such as by hammer forging simultaneously during the hammer forging process of producing composite barrel 20 by providing a mandrel with the desired chamber profile thereon. Alternatively, chamber 28 may be formed by either while tube-sleeve assembly 32, 34 remains on the mandrel in hammer forging machine or afterwards. Chamber 28 may have any suitable configuration and will be adapted to match the shape of the cartridge casing to be used in the firearm to properly support the cartridge during firing as is well known in the art. Accordingly, chamber 28 is not limited to any particular size and configuration.

It will be appreciated that the length and diameter of chamber 28 will vary depending on the caliber of the cartridge intended to be used with the composite barrel 20. Preferably, reinforcing end cap 100 has a length $L_R$ (FIG. 10) that is at least coextensive with the length $L_C$ of chamber 28 (see FIGS. 13A and 13B) to reinforce the chamber area and/or sleeve 34. More preferably, end cap 100 has a length $L_R$ that is longer than the length $L_C$ of chamber 28 as shown in FIGS. 13A and 13B such that the end cap extends forward a suitable distance beyond muzzle end 120 of chamber 28 (corresponding to the mouth end of the cartridge case) to reinforce the preferably lighter-weight and lower strength sleeve 34 from the pressures and forces of the expanding combustion gases associated with discharging the firearm. As shown in FIGS. 13A and 13B, a portion of outer sleeve 34 may lie adjacent to at least part of chamber 28. In other possible embodiments (not shown), however, reinforcing end cap 100 may extend forward past muzzle end 120 of chamber 28 even farther than shown in FIGS. 13A and 13B such that there is no portion of sleeve 34 that lies adjacent to any part of the chamber. It is well within the ambit of one skilled in the art to readily determine an appropriate length $L_R$ for end cap 100 based on the design requirement of the particular application, caliber of ammunition to be used with the firearm, and component materials.

In some embodiments having machined chambers 28, portions of inner tube 32 may be completely removed when tube material is removed to form the chamber depending on the caliber and type of the intended cartridge to be used with composite barrel 20. In some possible embodiments shown in FIG. 13B, post-forged machining of chamber 28 into barrel 20 results in complete removal of portions of inner tube 32 in part of the chamber area of the barrel where the diameter Dc of chamber 28 is largest (corresponding to the body of the cartridge case). Accordingly, chamber 28 is essentially formed entirely within reinforcing end cap 100. By contrast, portions of inner tube 32 in front or near muzzle end 120 of chamber 28, corresponding to the neck and shoulder area of the cartridge case, are not removed as shown in FIG. 13B.

In other possible embodiments shown in FIG. 13A, post-forged machining of chamber 28 into barrel 20 results in only partial removal of inner tube 32 in the chamber area of the barrel. Accordingly, inner tube 32 may have a reduced tube thickness Tt where the diameter Dc of chamber 28 is largest (corresponding to the body of the cartridge case) in contrast to visibly thicker portions of the tube in front of or near muzzle end 120 of the chamber (corresponding to the neck and shoulder of the cartridge case). In other possible embodiments (not shown), it will be appreciated that chamber 28 may have a generally uniform shape and diameter Dc along its length when prepared to receive cartridges that lack a defined shoulder and neck, such as some types of rimfire ammunition. Accordingly, the invention is not limited to chambers having any particular shape or configuration such as those shown herein having neck and should areas corresponding to cartridges having those features.

Although in the preferred embodiment inner tube 32 may extend completely through end cap 100, it is contemplated that in other embodiments tube 32 may be terminated flush with the end 111 of outer sleeve 34 (not shown) thereby forming a receiver end 26 wherein the tube does not extend beyond end 111 of the sleeve as shown in FIG. 10. Since end cap preferably is made of a high strength and ductility material similar to inner tube 32 and is capable of withstanding combustion pressures and forces unlike the preferably lighter-weight and more malleable sleeve 34, this type of construction is also feasible.

Once the reinforced composite barrel 20 with end cap 100 is completely forged and fabricated, it may then be attached to receiver 22 of the firearm as shown in FIGS. 13A and 13B by any suitable means.

Figure 14:
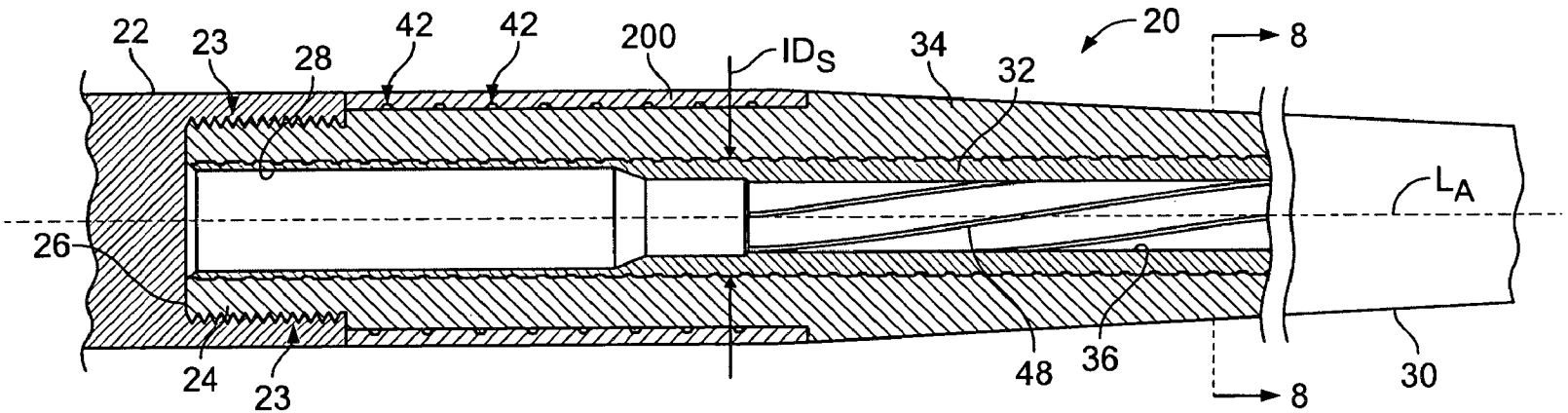
FIG. 14 is a cross-sectional view of the an alternative embodiment of a reinforcing member with the tube-sleeve assembly after forging.

In other embodiments contemplated for high combustion pressure applications, the receiver 22 of the firearm may provide some reinforcement to the portion of composite barrel 20 received therein if material of suitable strength and thickness is selected for the receiver (e.g., steel, steel-alloy, etc.). Accordingly, the reinforcing member in some embodiments may be a tubular-shaped cap 200 having an elongated annular or open cylindrical structure as shown in FIG. 14.

Tubular cap 200 preferably is hammer forged onto outer sleeve 34 in the same manner described herein and reinforces those portions of the sleeve proximate to chamber 28 to withstand the forces and pressures associated with discharging the firearm. The inner surface of tubular cap 200 may include threading 42 or other surface recesses which function similarly to other embodiments described herein to promote a strong bond between the cap and outer sleeve 34 when the two components are forged together. Receiver connection 24 of tube-sleeve assembly 32, 34 projects completely through end cap 200 as shown in FIG. 14 for attachment to receiver 22 in lieu of forming the receiver connection on the end cap (as shown in FIG. 10 for example). As shown, side portions 23 of receiver 22 lying adjacent to and overlying receiver connection 24 of outer sleeve 34 function to at least partially provide proper support in this area of the sleeve near chamber 28.

Although the reinforcing member for forged composite structures has been described herein for reinforcing a cartridge chamber of firearm barrel, in other embodiments contemplated the reinforcing member may be used to reinforce other portions of the barrel or in other types of composite structures unrelated to firearms in a similar manner. In addition, the reinforcing member may be used for composite structures described herein such as those useful in the aerospace industry (without limitation) where the lighter and less dense material is preferably disposed inside the heavier and denser material to provide resistance against externally-applied loads on the composite structures. In this latter application and type of construction, the reinforcing member may be used to strengthen and reinforce the composite structure at points where mechanical stresses (e.g., bending, torsion, tensile, compressive, etc.) and stress concentrations may be higher such as at points of attachment to various mounts and appurtenances. Accordingly, the applications where reinforcing members may be used in forged composite structures are not limited to those described herein.

Although the hammer forging process is described herein and preferred, it will be appreciated that other forging techniques and machines are contemplated and may be used to create composite barrels according to principles of the present invention described herein.

While the foregoing description and drawings represent the preferred embodiments of the present invention, it will be understood that various additions, modifications and substitutions may be made therein without departing from the spirit and scope of the present invention as defined in the accompanying claims. In particular, one skilled in the art will appreciate that the invention may be used with many modifications of structure, arrangement, proportions, sizes, materials, and components used in the practice of the invention, which are particularly adapted to specific needs and operating requirements, without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A forged composite firearm barrel comprising:

an inner tube having a longitudinally-extending bore and a first density;

an outer sleeve having a second density less than the first density of the inner tube, at least part of the tube received in a passageway in the sleeve; and a cylindrically-shaped reinforcing member permanently bonded and joined to an outer surface of the sleeve;

wherein the reinforcing member is configured as a cylindrical end cap adapted to be received onto or near a stepped rear end of the sleeve.

2. The barrel of claim 1, wherein the reinforcing member has a cavity and at least part of the outer sleeve is received in the cavity.

3. The barrel of claim 2, wherein at least part of the inner tube extends into and is also received in the cavity.

4. The barrel of claim 2, wherein the cavity of the reinforcing member includes a plurality of recesses that contain material embedded therein from an outer surface of the outer sleeve to prevent axial separation of the reinforcing member and outer sleeve during discharging of the firearm, the recesses being operative to permanently bond the reinforcing member and the outer sleeve together.

5. The barrel of claim 1, wherein the reinforcing member is permanently bonded to portions of both the outer sleeve and the inner tube.

6. The barrel of claim 1, wherein the reinforcing member has a third density greater than the second density of the sleeve.

7. The barrel of claim 1, wherein the reinforcing member has a third density that is substantially the same as or greater than the first density of the inner tube.

8. The barrel of claim 1, further comprising a cartridge chamber formed inside the reinforcing member for supporting the chamber during discharge of the firearm.

9. The barrel of claim 1, wherein the inner tube, outer sleeve, and reinforcing member are permanently joined together by hammer forging.

10. The barrel of claim 1, wherein the reinforcing member is made of steel or steel alloy.

11. The barrel of claim 1, wherein the inner tube and reinforcing member are made of a material selected from the group consisting of steel and steel alloy, and the outer sleeve contains a material selected from the group consisting of aluminum, aluminum-alloy, titanium, and titanium-alloy.

12. A forged composite firearm barrel comprising:

an inner tube having a longitudinally-extending bore and a first density;

an outer sleeve having a second density less than the first density of the inner tube, at least part of the tube received in a passageway in the sleeve;

a cylindrically-shaped reinforcing member permanently bonded and joined to an outer surface of the sleeve; and a cartridge chamber formed inside the reinforcing member for supporting the chamber during discharge of the firearm;

wherein the chamber has a length and the reinforcing member has a length at least coextensive with the length of the chamber.

13. A forged composite firearm barrel with a reinforced chamber comprising:

an inner tube having a longitudinally-extending bore and a first density;

an outer sleeve having a second density less than the first density of the inner tube, the outer sleeve receiving at least part of the inner tube therein;

a cylindrically shaped hollow reinforcing member disposed on the sleeve and having a third density greater than the second density of the outer sleeve; and a chamber configured for receiving a cartridge and being disposed at least partially inside the reinforcing member for supporting the chamber during discharge of the firearm;

wherein the inner tube, outer sleeve, and reinforcing member are permanently bonded and joined together via a plurality of helical grooves formed on both the tube and reinforcing member, the grooves containing material embedded therein from the outer sleeve to prevent axial separation of the reinforcing member, inner tube, and outer sleeve during discharging of the firearm.

14. The barrel of claim 13, wherein at least part of the chamber is formed within the inner tube, a portion of the inner tube being disposed between the chamber and the reinforcing member.

15. The barrel of claim 13, wherein at least a portion of the outer sleeve lies adjacent to at least part of chamber, wherein the portion of the outer sleeve adjacent to the chamber is supported by the reinforcing member.

16. The barrel of claim 13, wherein the reinforcing member includes an internal cavity receiving a stepped end of the outer sleeve therein, the cavity defining an internal surface comprising the helical recesses that contain the embedded material from the outer sleeve.

17. The barrel of claim 13, wherein the reinforcing member has a cylindrically-shaped reduced diameter portion for mounting the barrel to the firearm.

18. The barrel of claim 13, wherein the chamber has a length and the reinforcing member has a length at least coextensive with a length of the chamber.

19. A reinforced composite firearm barrel formed by forging, the barrel comprising:

an inner tube defining a central bore providing a bullet path and including an exterior surface having a plurality of recesses for bonding to the sleeve;

an outer sleeve defining a passageway and the inner tube received at least partially in the passageway;

a cylindrically-shaped reinforcing member defining an internal cavity and at least partially receiving a portion of the sleeve therein, the cavity including a plurality of recesses for bonding to the sleeve;

a chamber for receiving a cartridge and being disposed at least partially within the reinforcing member for strengthening the chamber;

wherein the inner tube and reinforcing member have a density greater than the density of the sleeve and are each permanently bonded to the sleeve by the recesses in the inner tube and reinforcing member wherein material from the outer sleeve is received and embedded in the recesses to prevent axial separation of the reinforcing member, the inner tube, and the outer sleeve during discharging of the firearm.

20. The barrel of claim 19, wherein the internal cavity extends completely through the reinforcing member from end to end.

21. The barrel of claim 20, wherein the internal cavity of the reinforcing member has an enlarged portion having a first diameter and a reduced portion having a second diameter smaller than the first diameter, and a shoulder formed between the enlarged and reduced diameter portions.

22. The barrel of claim 21, wherein the outer sleeve has a reduced diameter portion having a rear end that is received into the enlarged portion of the reinforcing member.

23. The barrel of claim 19, wherein the inner tube extends beyond a rear end of the outer sleeve into the cavity of the reinforcing member.

24. The barrel of claim 19, wherein the reinforcing member has a cylindrically-shaped reduced diameter rear portion for mounting the barrel to the firearm.

* * * * *